US005956913A

United States Patent [19]

Nicholson

[11] Patent Number: 5,956,913

[45] **Date of Patent: *Sep. 28, 1999**

[54] SHINGLE SYSTEM AND FASTENING STRIP

[76] Inventor: Joseph R. Nicholson, R.R. #2, Monkton, Ontario, Canada, N0K 1P0

[ * ] Notice: This patent is subject to a terminal disclaimer.

[21] Appl. No.: 08/937,026

[22] Filed: Sep. 24, 1997

Related U.S. Application Data

[63] Continuation of application No. 08/430,057, Apr. 13, 1995, Pat. No. 5,685,117.

[51] Int. Cl.[6] ..... E04D 1/00

[52] U.S. Cl. ..... 52/520; 52/533; 52/536; 52/539; 52/557; 52/748.1; 52/547

[58] Field of Search ..... 52/520, 521, 528, 52/529, 533, 537, 539, 545, 547, 551, 552, 748.1, 57, 536

[56] References Cited

U.S. PATENT DOCUMENTS

| | | | |
|---|---|---|---|
| 276,085 | 8/1883 | Severin . | |
| 307,590 | 11/1884 | Regan . | |
| 347,843 | 8/1886 | Thorn . | |
| 373,373 | 11/1887 | Montross . | |
| 385,408 | 7/1888 | Cushman . | |
| 503,173 | 8/1893 | Spahmer, Jr. . | |
| 512,188 | 1/1894 | Goodrich . | |
| 855,757 | 6/1907 | Crabbs et al. . | |
| 943,888 | 12/1909 | Pedlar . | |
| 968,887 | 8/1910 | Roth . | |
| 1,519,350 | 5/1924 | Belding . | |
| 1,549,723 | 6/1925 | Mattison . | |
| 1,570,516 | 9/1926 | Miller . | |
| 1,572,377 | 3/1926 | Blair . | |
| 1,582,266 | 12/1926 | Harshberger . | |
| 1,670,041 | 2/1928 | Miller . | |
| 1,743,206 | 1/1930 | Fulenwider et al. . | |
| 1,819,717 | 4/1931 | Mangano . | |
| 1,876,597 | 6/1932 | Bennett . | |
| 1,971,517 | 2/1934 | Belding . | |
| 2,126,676 | 7/1938 | Thomas . | |
| 2,184,328 | 12/1939 | Wildman . | |
| 2,226,886 | 12/1940 | Willis . | |
| 2,682,236 | 8/1954 | Holmstrom et al. . | |
| 2,685,852 | 1/1954 | Gödel . | |
| 3,110,130 | 11/1963 | Trachtenberg | 52/545 |
| 3,282,009 | 11/1966 | Chalmers | 52/545 X |
| 3,347,001 | 3/1967 | Cosden . | |

(List continued on next page.)

FOREIGN PATENT DOCUMENTS

| | | | |
|---|---|---|---|
| 284350 | 9/1988 | European Pat. Off. . | |
| 1569562 | 6/1969 | France | 52/551 |
| 258039 | 7/1988 | Germany | 52/518 |
| 229072 | 8/1994 | Japan . | |
| 2123058 | 1/1984 | United Kingdom . | |
| 2245617 | 1/1992 | United Kingdom . | |

*Primary Examiner*—Robert Canfield
*Attorney, Agent, or Firm*—Bereskin & Parr

[57] ABSTRACT

A shingle system comprising a fastening strip and a plurality of shingles. The fastening strip includes a top flange portion and a fastener portion. A gasket is located along a bottom surface of the fastening portion. The plurality of shingles each include top and bottom edges and opposing side edges. The bottom edge includes an underturned flange for engaging the top flange portion of the fastening strip. Overturned or underturned flanges are provided on the side edges to connect adjacent shingles along the sides. In a further embodiment, the shingles comprise first and second shingle configurations where the first shingle configuration includes side edges that are tapered and either overturned or underturned, and where the second shingle configuration includes side edges having an opposite taper to the first shingle configuration as well as an opposite flange. In a further embodiment, the shingle system further comprises a roof cap including tailing and leading edges and opposing side edges. The leading edge of the roof cap includes an underturned flange for engaging the fastening strip.

42 Claims, 4 Drawing Sheets

U.S. PATENT DOCUMENTS

| | | | |
|---|---|---|---|
| 3,411,259 | 11/1968 | Anderson et al. | 52/533 X |
| 3,418,777 | 12/1968 | Gillis | 52/529 X |
| 3,545,157 | 10/1970 | Cziptschirsch et al. . | |
| 3,913,294 | 10/1975 | Freilborg . | |
| 4,096,679 | 6/1978 | Naz | 52/551 |
| 4,187,661 | 2/1980 | Piory | 52/551 X |
| 4,283,897 | 8/1981 | Thompson . | |
| 4,292,781 | 10/1981 | Chalmers et al. | 52/545 X |
| 4,356,673 | 11/1982 | Gailey . | |
| 4,382,354 | 5/1983 | Gailey et al. . | |
| 4,593,512 | 6/1986 | Funaki . | |
| 4,717,614 | 1/1988 | Bondoc et al. . | |
| 4,947,609 | 8/1990 | Champagne | 52/547 X |
| 5,076,037 | 12/1991 | Crick et al. . | |
| 5,131,200 | 7/1992 | McKinnon . | |
| 5,150,555 | 9/1992 | Wood . | |
| 5,247,771 | 9/1993 | Poplin . | |
| 5,295,340 | 3/1994 | Collins . | |
| 5,339,608 | 8/1994 | Hollis et al. | 52/547 X |
| 5,355,649 | 10/1994 | Berridge | 52/545 X |
| 5,365,711 | 11/1994 | Pressutti et al. . | |
| 5,369,929 | 12/1994 | Weaver et al. . | |
| 5,392,579 | 2/1995 | Champagne | 52/547 X |
| 5,685,117 | 11/1997 | Nicholson | 52/520 |

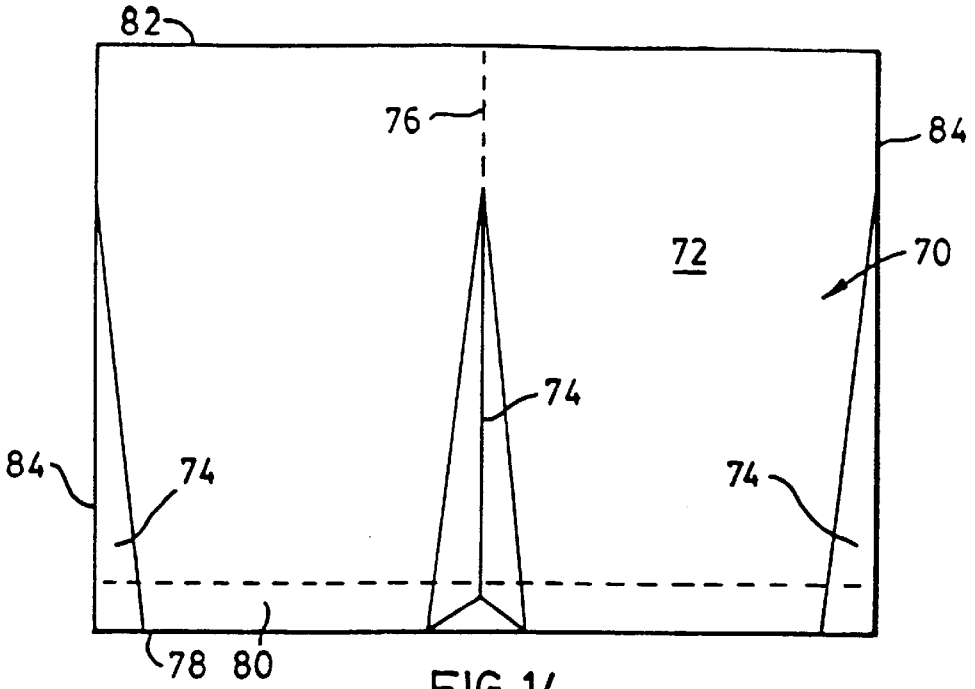
FIG. 14
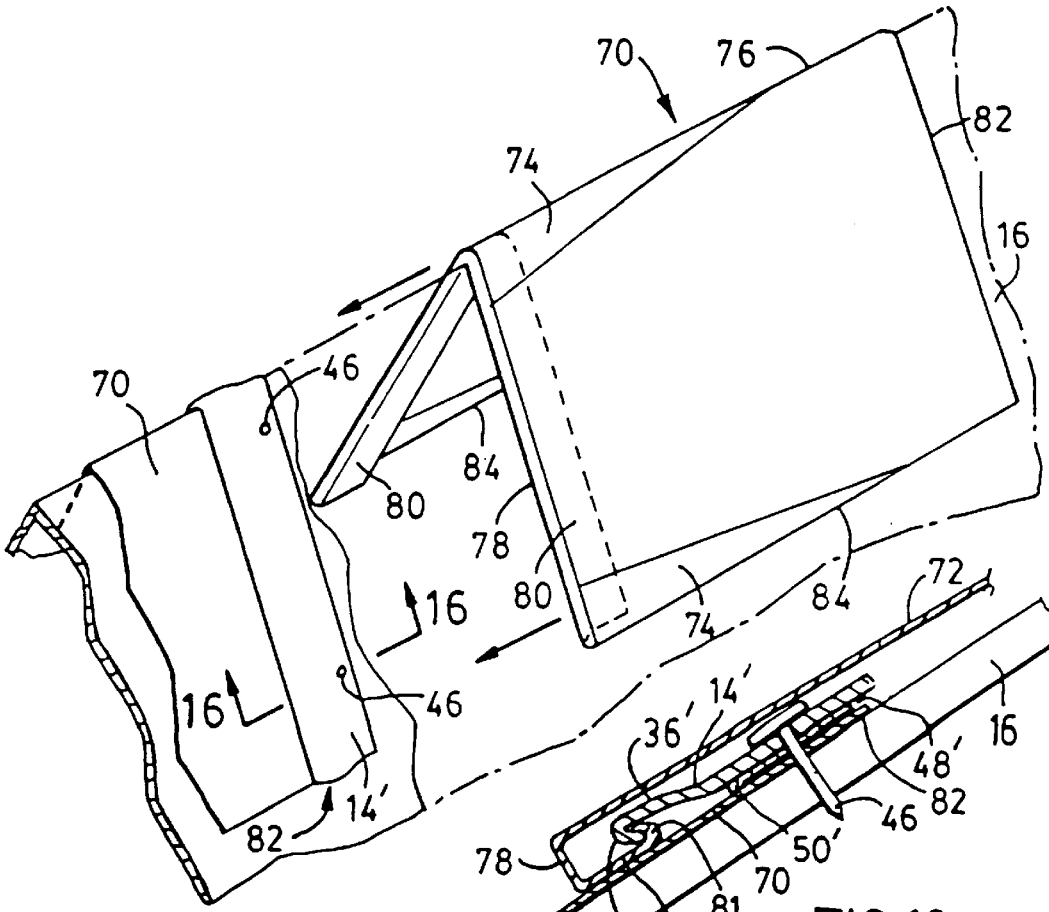
FIG. 15
FIG. 16

SHINGLE SYSTEM AND FASTENING STRIP

This application is a continuation of Ser. No. 08/430,057 filed Apr. 13, 1995, now U.S. Pat. No. 5,685,117.

FIELD OF THE INVENTION

The present invention relates to weather coverings and in particular to shingles and related components.

BACKGROUND OF THE INVENTION

Numerous designs for metal shingles have been developed over the years. These shingles typically have edge flanges that are adapted to interconnect with adjacent shingles to attempt to create a substantially weather resistant barrier. Examples of such shingles are provided in U.S. Pat. No. 1,670,041 (Miller), U.S. Pat. No. 1,743,206 (Fulenwider et al.) and U.S. Pat. No. 1,876,597 (Bennett).

The Miller patent teaches a two-course shingle system where each shingle has an upper course with outwardly tapering side edges and a lower course with inwardly tapering side edges. The top, bottom and side edges of the shingle are overturned and underturned for engaging adjacent shingles. One problem with this shingle system is that shingle is subject to leakage during severe weather conditions when water may be blown upwardly to the upper course of the shingle through openings in the interlocking edges of adjacent shingles. Another problem is that the system requires close tolerances between the engaging shingles. This limits the adjustability of the shingles relative to the course below. This complicates installation when the installer is faced with obstructions such as bathroom vents, hips or valleys.

The Fulenwider patent teaches a single course shingle system where each shingle has opposing side edges that define corresponding shoulders, an underturned bottom edge and an overturned top edge. The overturned top edge is defined by a separate lock fastener that is secured to an upturned flange on the top edge of the shingle. One problem with this shingle design is that the lock fastener does not adequately seal the joint between adjacent shingles. As a result, this shingle design is subject to leakage during severe weather conditions. Another problem with the shingle system is the structure of the side shoulders. The shoulders are difficult to reproduce on site if it is necessary for an installer to cut a shingle from top to bottom to account for obstructions. As a result, installation is complicated.

The Bennett patent teaches a single course shingle system where each shingle has opposing overturned and underturned side edges and an underturned bottom edge. A separate dam strip is provided for fastening along the top edge of a course of shingles. The dam strip has a foot portion for attaching the strip to the roof, a bulge for receiving the top edge of the shingles and an angular strip that extends generally perpendicular to the roof line. One problem with this system is that the dam strip does not adequately guard against water leakage through nail holes where each shingle is attached to the roof. Also, the strip must include a cutaway portion to receive the joint at adjacent side edges. This cutaway portion is a further area where leakage can occur. Finally, the side edges have complicated contours that are difficult to reproduce on site if an installer needs to cut a shingle.

There is a need for a roofing system that overcomes the above problems. Furthermore, the roofing system should be relatively simple to install and inexpensive to manufacture.

SUMMARY OF THE INVENTION

In one aspect the invention provides a shingle system comprising a plurality of shingles, each said shingle having a top edge and a bottom edge;

a plurality of fastening strips, each said fastening strip having a top flange for covering said top edge of at least one of said shingles;

a fastening portion located on said top flange for receiving fasteners to fasten at least said fastening strip to a surface;

a connector located on each said shingle for connecting said shingle to a corresponding said fastening strip proximate to said bottom edge; and a gasket located on a bottom surface of the fastening portion of said fastening strip.

In another aspect, the invention provides a fastening strip for shingles comprising:

an elongate top flange including a fastener portion for receiving fasteners;

a hook disposed along the length of said top flange for connecting said fastening strip to at least one upper shingle;

a lip disposed along the length of said top flange for aligning said fastening strip relative to a top edge of at least one lower shingle; and a gasket disposed continuously along the length of the top flange on a bottom surface of the fastener portion for providing a weather resistant seal between the fastening strip and said at least one lower shingle.

In another aspect, the invention provides a shingled surface comprising:

a plurality of fastening strips arranged on a surface in parallel continuous rows, each said fastening strip having a top flange that includes a fastening portion;

a plurality of shingles, each said shingle having a top edge, a bottom edge and a connector, said shingles being arranged on said surface with said top edge of each shingle being covered by said top flange of one row of fastening strips, and each shingle being connected by said connector proximate to said bottom edge to another row of said fastening strips;

a plurality of fasteners extending through said fastening portion of said fastening strips to fasten at least said fastening strips to said surface; and a gasket located on a bottom surface of the fastening portion of said fastening strips, said gasket defining a weather resistant seal between said fastening strip and said shingles proximate to said top edge.

In another aspect, the invention provides a method of installing a plurality of shingles onto a surface, comprising the steps of:

(a) obtaining a plurality of fastening strips, each said fastening strip having a top flange that includes a fastener portion;

(b) obtaining a plurality of shingles, each said shingle having a top edge and a bottom edge, and each said shingle having a connector for connecting said shingle to said fastening strip proximate to said bottom edge;

(c) fastening at least one said fastening strip to said surface to define a lower fastening strip row;

(d) positioning at least one of said shingles on said surface with said connector connecting to said lower fastening strip row to define a shingle course;

(e) positioning at least one of said fastening strips on said surface with said top flange covering said top edge of said at least one shingle in said shingle course to define an upper fastening strip row;

(f) fastening said fastening strips in said upper fastening strip row to said surface with fasteners, said fasteners extending through both the fastening strip and said shingle into said surface, said upper fastening strip row now defining a new lower fastening strip row; and (g) repeating steps (d) through (f) until a desired amount of said surface is covered with said shingles.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which:

FIG. 14 is a top view of a roof cap flat in accordance with the present invention;

FIG. 15 is a perspective view of the roof cap flat of FIG. 14 that has been bent to a desired angle to form a roof cap for fitting to a roof; and FIG. 16 is a partial sectional view of adjacent courses of roof caps attached to a roof as viewed along lines 16—16 of FIG. 15.

DETAILED DESCRIPTION OF THE PREFERRED EMBODIMENT

Figure 1:
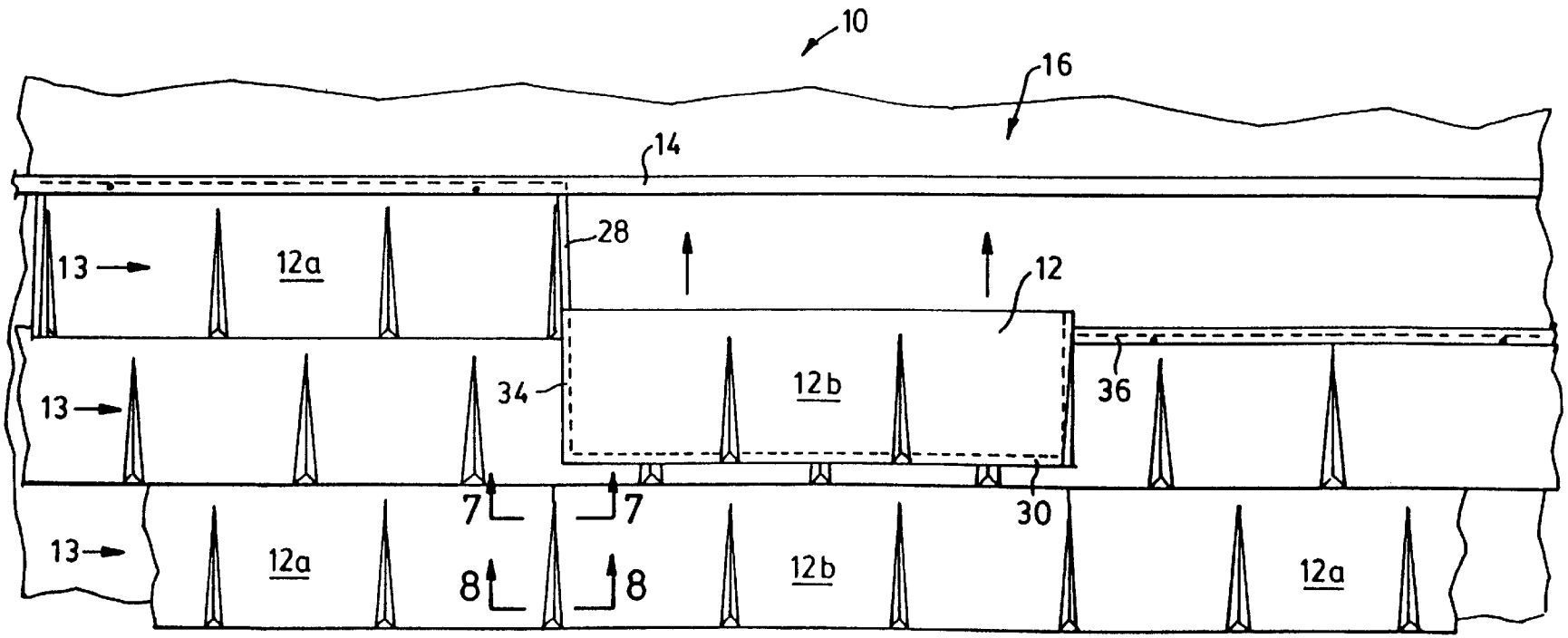
FIG. 1 is a top view of a roof incorporating a plurality of shingles and fastening strips in accordance with the shingle system of the present invention.

A shingle system in accordance with the present invention is shown generally at 10 in FIG. 1. The shingle system 10 comprises a plurality of shingles 12 and a fastening strip 14. The shingles 12 are applied to a surface 16 such as a roof.

The shingles 12 each comprise a body 18 having a top edge 20, a bottom edge 22 and two opposing side edges 24. The bottom edge 22 is bent to define an underturned flange 30. A connector 32 (see FIGS. 6, 10 and 12) is located on the flange 30. The body 18 is preferably rectangular with the top and bottom edges 20 and 22 being longer than the side edges 24. It will be appreciated however that the shingles 12 may have other desired shapes that combine with adjacent shingles 12 in a pattern to cover the surface 16.

The shingle body 18 is formed from a sheet of metal, plastic or other durable material that is molded, shaped or bent into a desired form. A plurality of peaks 26 may be formed in the sheet by a stamping, molding or other appropriate process. The peaks 26 are provided to add rigidity to the body of the shingle 12 and to provide a decorative appearance to the shingled roof. It will be noted that partial peaks 26*a* are provided adjacent to the side edges 24 of the shingles 12 so that adjacent shingles 12 will combine to form a single peak 26.

Figure 6:
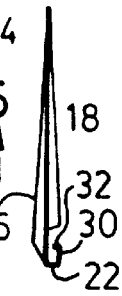
FIG. 6 is a sectional view of the second shingle of FIG. 3 taken along lines 6—6.
Figure 10:
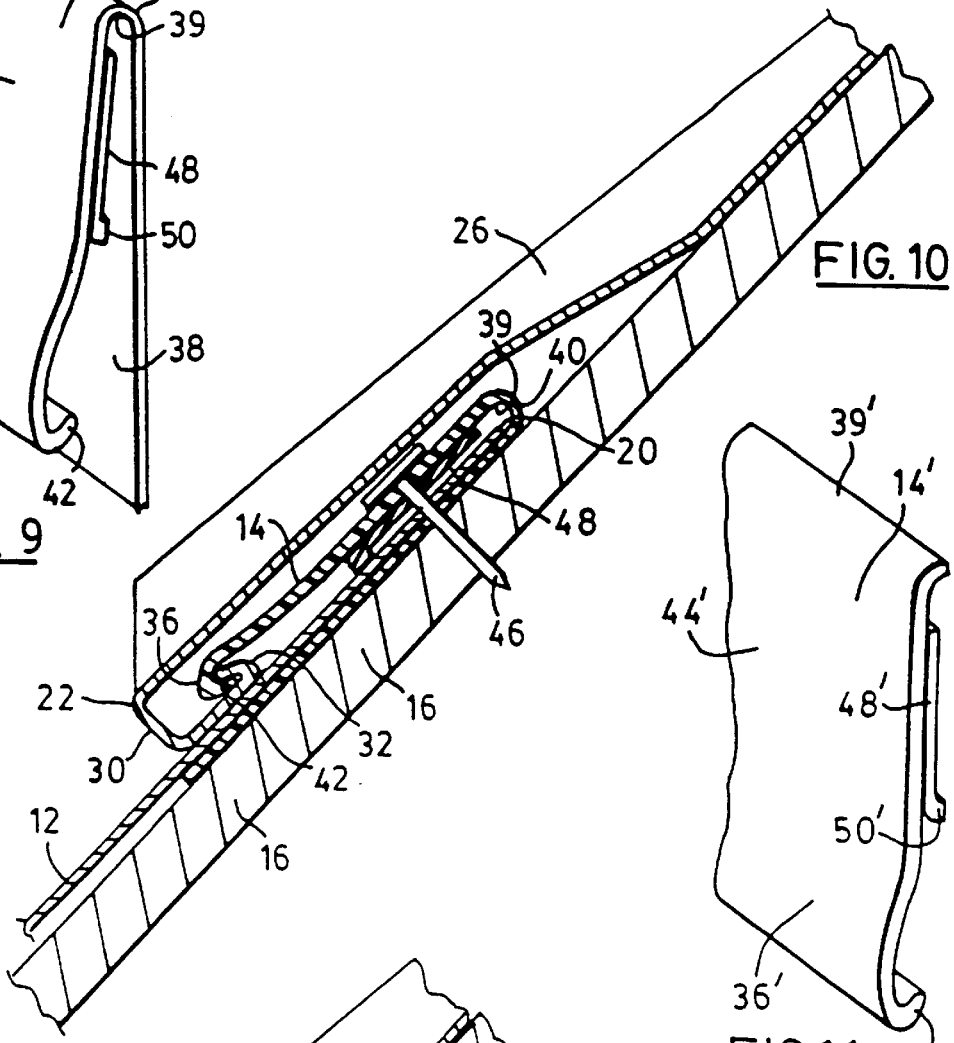
FIG. 10 is a partial sectional view of adjacent courses of shingles attached to a roof using the fastening strip of FIG. 9.
Figure 12:
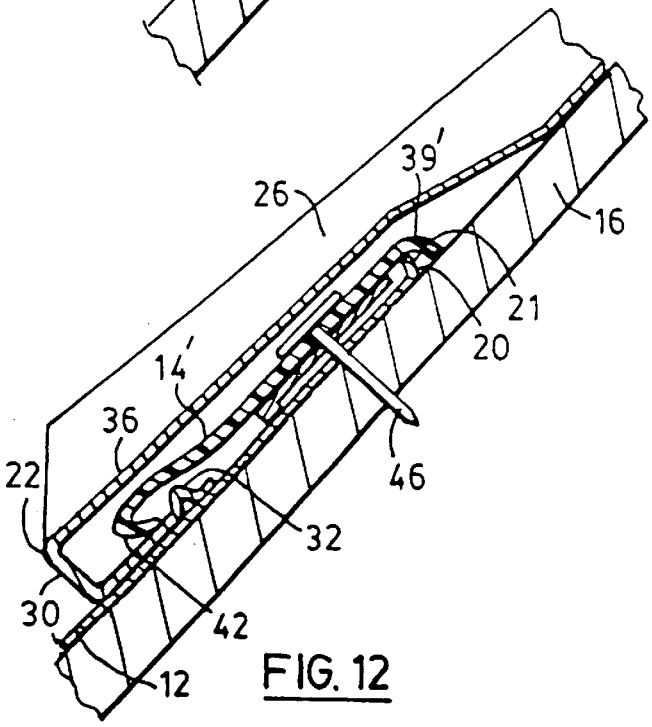
FIG. 12 is a partial sectional view of adjacent courses of shingles attached to a roof using the fastening strip of FIG. 11.

It is desirable that a substantial portion of the body 18 remain flat so that it may rest against the roof surface 16 and allow the shingles 12 to be walked upon. Referring to FIGS. 6, 10 and 12 it can be seen that the shingle 12 is contoured from top to bottom so that a substantial portion rests against the roof 16 and the bottom portion overlaps a fastening strip 14 or 14' and a lower course shingle 12. This contouring is preferably incorporated as part of the decorative shaping of the shingle. For instance, the bottom portion of the shingle running adjacent to the bottom edge 22 may be stamped to incorporate the contour.

Figure 4:
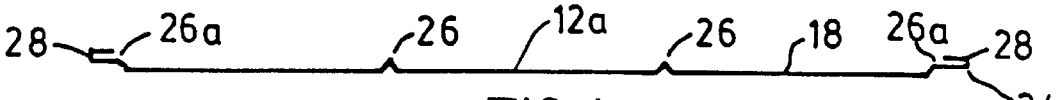
FIG. 4 is a sectional view of the first shingle of FIG. 2 taken along lines 4—4.
Figure 5:
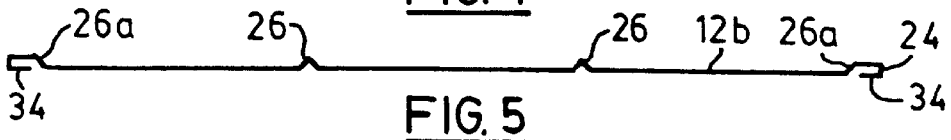
FIG. 5 is a sectional view of the second shingle of FIG. 3 taken along lines 5—5.
Figure 2:
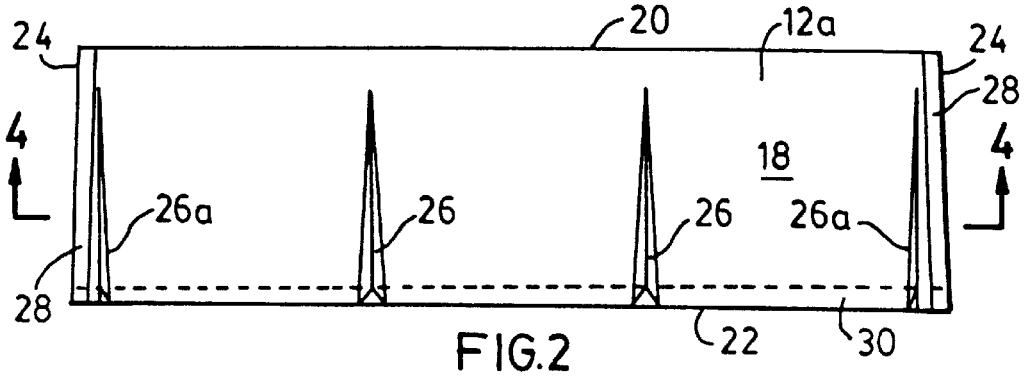
FIG. 2 is a top view of a first shingle in accordance with a first embodiment of the present invention.
Figure 3:
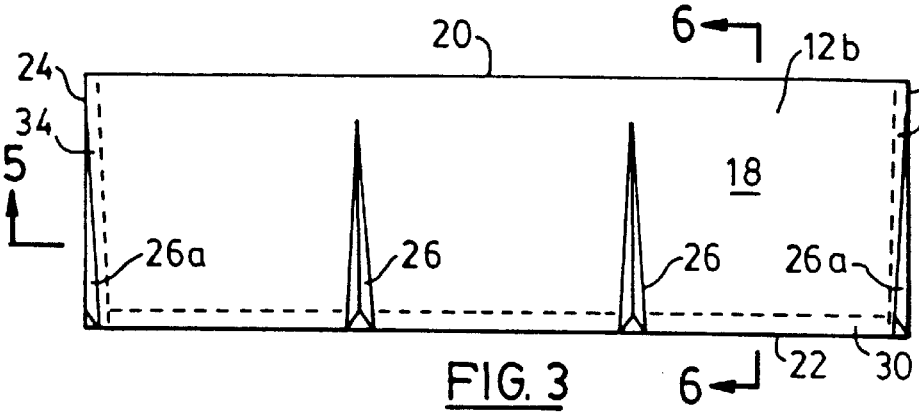
FIG. 3 is a top view of a second shingle in accordance with the first embodiment of the present invention.

Referring to FIGS. 1–8, a first embodiment of the shingle system 10 is shown. In this embodiment, two configurations of shingles are provided in an alternating pattern along each shingle course 13. A first shingle 12*a* is shown in FIGS. 2 and 4 and a second shingle 12*b* is shown in FIGS. 3, 5 and 6.

Referring to FIGS. 2 and 4, the first shingle 12*a* has an overturned flange 28 defined along each side edge 24. The top edge 20 of the first shingle 12*a* is shorter than the bottom edge 22 so that the side edges 24 taper outwardly from top to bottom.

Referring to FIGS. 3 and 5, the second shingle 12*b* has an underturned flange 34 defined along each side edge 24. The top edge 20 of the second shingle 12*b* is longer than the bottom edge 22 so that the side edges 24 taper inwardly from top to bottom.

Figure 7:
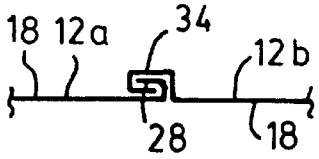
FIG. 7 is a sectional view of interconnected side edges of the shingles of FIG. 1 taken along lines 7—7.
Figure 8:
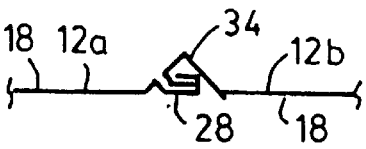
FIG. 8 is a sectional view of interconnected side edges of the shingles of FIG. 1 taken along lines 8—8.

As shown in FIGS. 7 and 8, the overturned flange 28 and underturned flange 34 of adjacent side edges 24 of shingles 12*a* and 12*b* are adapted to slidably interconnect. The flanges 28 and 30 have a relatively simple L-shaped construction so that an installer can cut a shingle 12 from top to bottom and form a flange with pliers if necessary. The flanges 28 and 34 are arranged in substantially the same plane as the underside of the shingle body 18 so that the body 18 rests against the roof 16. The opposing tapers of the first and second shingles 12*a* and 12*b* help to snugly connect the shingles together. It has been found that a taper of ¼ inch over a height of twelve inches between the top and bottom edges provides a satisfactory snug fit.

Figure 9:
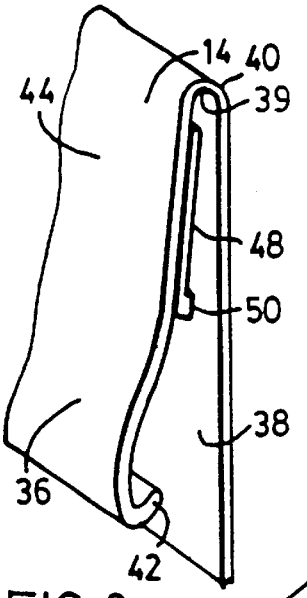
FIG. 9 is a perspective partial view of a first embodiment of fastening strip in accordance with the present invention.

Referring to FIGS. 9 and 10, a first embodiment of fastening strip 14 is shown. The fastening strip 14 is elongate and preferably has a length that is sufficient to extend along the top edge 20 of several adjacent shingles 12. The fastening strip 14 is preferably constructed from metal or plastic.

The fastening strip 14 includes a top flange 36 and a bottom flange 38 connected by a living hinge 40. The bottom flange 38 of the fastening strip 14 is substantially flat for resting against the surface of a roof 16. The bottom flange 38 may be tacked into place on the roof 16 to conveniently set the position of the fastening strip 14 prior to installing a course 13 of shingles 12. The living hinge 40 conveniently connects the top and bottom flanges 36 and 38 to facilitate lifting the top flange 36 to tack the bottom flange 38 into place on the roof 16. The living hinge 40 also defines a lip 39 for conveniently aligning the fastening strip 14 along the top edge 20 of a shingle 12. Overall, the fastening strip 14 allows each course 13 of shingles 12 to be adjusted relative to a lower course 13. This accounts for slight imperfections that can occur during installation.

The top flange 36 has a hook 42 defined along its free edge for engaging the connector 32 that is located on the underturned flange 30 of an upper course shingle 12. The connector 32 depicted in FIG. 10 is a simple hook that engages to the hook 42 on the fastening strip 14. The top flange 36 further includes a substantially flat fastener portion 44 for receiving a fastener such as a nail, screw or other appropriate means for attaching a shingle 12 to the roof.

The top edge 20 of a lower course shingle 12 is enveloped between the top flange 36 and bottom flange 38 of the fastening strip 14. A gasket 48 is located on the bottom surface of the fastener portion 44 of the top flange 36 for sealing the connection between the fastener 46, top flange 36 and the lower course shingle 12. The gasket 48 preferably includes a lip 50 at its lower end for improving the seal between the gasket 48 and the lower course shingle 12. The gasket 48 is preferably formed from a sealing material that is weather resistant such as silicone or a rubber composite. The living hinge 40 provides a secondary water resistant guard behind the gasket 48.

Figure 11:
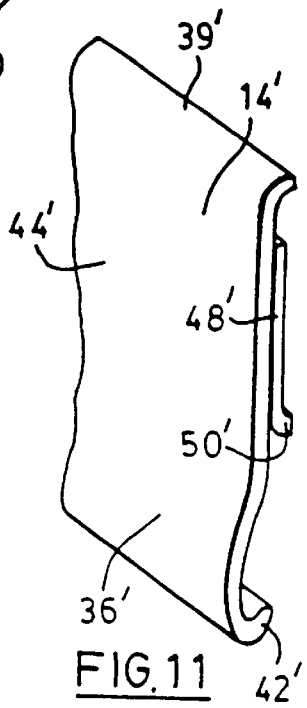
FIG. 11 is a partial perspective view of a second embodiment of fastening strip in accordance with the present invention.

Referring to FIGS. 11 and 12, a second embodiment of fastening strip is shown as 14'. The fastening strip 14' is similar in construction to the first embodiment of fastening strip 14 except that no bottom flange 38 and living hinge 40 is provided. The fastening strip 14' includes a top flange 36' and gasket 48' with lip 50'. The top flange 36' has a hook 42' defined at one free edge, a flat fastener portion 44' for receiving fasteners 46 and a lip 39' at the other edge for aligning the fastening strip 14' along the top edge 20 of a shingle 12. A different form of connector 32 is shown by way of example in FIG. 10.

When the second embodiment of fastening strip 14' is used, the top edge 20 of the lower course shingle 12 rests against the roof 16. The fastening strip 14' is then positioned along the top edge 20 and fastened with fasteners 46. The fasteners 46 extend through the flat fastening portion 44' of the top flange 36', the gasket 48', the lower course of shingle 12, and the roof 16. The top edge 20 of the lower course shingle 12 preferably defines an upturned lip 21 to add rigidity along the top edge 20 and to provide a secondary water resistant seal along the top edge 20 behind the gasket 48'.

The method of installing the first embodiment of shingle system 10 is shown in FIG. 1 and described below. A fastening strip 14 is fastened along a lower edge of a roof 16 using fasteners 46. The first course 13 of shingles 12*a* and 12*b* is then arranged along the roof with the first and second shingles 12*a* and 12*b* alternating along the course 13 such that the overturned flange 28 and underturned flange 34 of adjacent side edges 24 slidably interconnect. The underturned flange 30 on the bottom edge 22 of the shingles 12*a* and 12*b* is hooked beneath the top flange 36 of the fastening strip 14. Several shingles 12*a* and 12*b* may be laid without fasteners 46 so that they can be adjusted to a desired position along the course 13. Once the shingles are positioned as desired, a fastening strip 14 is positioned along the top edge 20 of the shingles 12*a* and 12*b* and the shingles 12*a* and 12*b* and fastening strip 14 are fastened to the roof 16 with the fasteners 46. The next course 13 of shingles 12*a* and 12*b* is then ready to be laid. In the alternative, an installer may first install the fastening strips 14 along successive courses 13 prior to installing the shingles. It will be appreciated that either the first or second embodiment of fastening strip 14 or 14' may be utilized for attaching the above-noted shingle system 10.

It will be appreciated that the shingle system can be installed with simple tools such as snips and pliers. Also, it will be appreciated that the side to side adjustability facilitated by the system and the low profile of the fastening strip 14 or 14' allows the shingle to be installed around vents and the like using a similar cutout method as is used for conventional asphalt or cedar shingles. The system thus provides simplified installation compared to conventional metal shingles.

The fastening strip 14 or 14' acts to provide a water resistant seal along the top edge 20 of a shingle course 13. In effect the course 13 of shingles 12 is substantially sealed without relying upon the adjacent upper course 13 of shingles 12 to be arranged in precise relation to the lower course 13. This allows the installer the freedom to adjust the next shingle course 13 to a desired position to account for obstacles without effecting the water resistant fit of the shingles 12 relative to the lower course 13.

Figure 13:
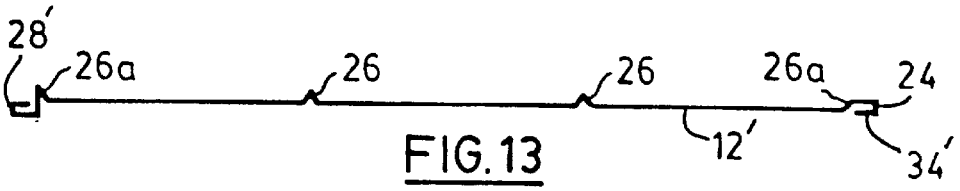
FIG. 13 is a sectional view of a second embodiment of shingle in accordance with the present invention.

Referring to FIG. 13, a side-to-side sectional view (similar to FIGS. 4 and 5) is shown of a second embodiment of shingle 12'. The second embodiment of shingle 12' is similar to the first embodiment in all respects except that one side edge 24 has an overturned flange 28' and the other side edge 24 has an underturned flange 34'. Also, the side edges 24 have no taper from top to bottom. This second embodiment of shingle 12' does not require a two shingle system such as is used for the first embodiment. Instead, a single shingle 12' is adapted with flanges 28' and 34' on its side edges 24 for interconnecting with an identical single shingle 12'. An advantage of this arrangement is that only one type of shingle 12' needs to be used for covering the roof 16. It will be appreciated that the method for fastening the shingles 12' to the roof using either the first or second embodiment of fastening strips 14 or 14' is similar to the method described earlier with respect to the first embodiment of shingle 12*a* and 12*b*.

Referring to FIGS. 14–16, a roof cap 70 is depicted for covering the peak of the roof 16. As shown in FIG. 14, the roof cap 70 is provided as a flat sheet 72 having a peak 74 defined along its mid-point. The peak 74 defined along the mid-point of the roof cap 70 defines a fold line 76 for bending the roof cap 70 evenly along its length. The roof cap 70 has a leading edge 78 that defines an underturned flange 80 having a hook 81. The roof cap 70 also has a tailing edge 82 and opposing side edges 84 all of which are flat. Referring to FIG. 15, the roof cap 70 is bent on site to a desired angle approximating the angle of the roof peak. The side edges 84 may taper outwardly from the tailing edge to the leading edge 78 so that bent roof cap 70 has substantially even sides despite the deformity caused by the peak 74.

Referring to FIG. 16, the second embodiment of fastening strip 14' as described above is cut to a length approximating the width between the side edges 84 of the roof cap 70. The fastening strip 14' is similarly bent on site at a mid-point to an angle approximating the roof peak angle. A first course of fastening strip 14' is fastened to one end of the roof 16 with the top flange 36' facing outwardly over the roof end. A roof cap 70 is then positioned with the hook 81 of the underturned flange 80 engaging the hook 42' of the top flange 36' of the fastening strip 14'. A second fastening strip 14' is then bent and positioned along the tailing edge 82 of the roof cap 70 and fastened to the roof 16 with the fastener 46. The exercise is then repeated along the entire length of the roof peak.

It is to be understood that what has been described are preferred embodiments of the invention. The invention nonetheless is susceptible to certain changes and alternative embodiments fully comprehended by the spirit of the invention as described above, and the scope of the claims set out below.

I claim:

1. A shingle system comprising:

a plurality of shingles, each said shingle having a top edge and a bottom edge;

a plurality of fastening strips, each said fastening strip having a top flange for covering said top edge of at least one of said shingles;

a fastening portion located on said top flange for receiving fasteners to fasten at least said fastening strip to a surface;

a connector located on each said shingle for connecting said shingle to a corresponding said fastening strip proximate to said bottom edge; and a gasket located on a bottom surface of the fastening portion of each said fastening strip.

2. A shingle system as claimed in claim 1, wherein each said gasket extends as a strip along the length of one said fastening strip.

3. A shingle system as claimed in claim 2, wherein at least one said gasket includes a lip protruding downwardly relative to said bottom surface of a respective fastening portion, said lip extending along the length of a respective said fastening strip.

4. A shingle system as claimed in claim 3, wherein each said gasket is formed from a rubber composite.

5. A shingle system as claimed in claim 1, wherein each said fastening strip further comprises a bottom flange that extends beneath a bottom surface of said top flange, said bottom flange being connected to said top flange by a hinge.

6. A shingle system as claimed in claim 1, wherein each said shingle includes side edges, said side edges including side edge connecting means for connecting adjacent side edges of shingles together.

7. A shingle system as claimed in claim 6, wherein said side edge connecting means comprises an overturned flange defined along one side edge and an underturned flange defined along an opposing side edge.

8. A shingle system as claimed in claim 6, wherein said plurality of shingles comprises a plurality of first shingles and a plurality of second shingles, said side edge connecting means on each of said first shingles comprising overturned flanges on said opposing side edges, and said side edge connecting means on each of said second shingles comprising underturned edges on said opposing side edges, wherein said first and second shingles are arranged alternately on a shingle course.

9. A shingle system as claimed in claim 8, wherein, for at least one of said first and second shingle configurations, the length of the top edge of the shingle differs from the length of the bottom edge of the shingle to define tapered side edges.

10. A shingle system as claimed in claim 9, wherein each of said first and second shingle configurations define tapered side edges, the taper of the first shingle configuration being opposite to the taper of the second shingle configuration.

11. A shingle system as claimed in claim 1, wherein each said shingle has peaks defined on a weather exposed surface.

12. A shingle system as claimed in claim 11, wherein said peaks are symmetrical along a center line, and wherein a partial peak is defined at the side edges of the shingles to facilitate formation of a single peak when the side edges of two shingles are adjacent to one another.

13. A shingle system as claimed in claim 1, further comprising a plurality of roof caps, each said roof cap having a leading edge, a tailing edge and opposing side edges, and each said roof cap defining a roof cap connector for connecting said roof cap to a fastening strip.

14. A shingle system as claimed in claim 13, wherein each said roof cap is connected by said roof cap connector to a fastening strip proximate to said leading edge.

15. A shingle system as claimed in claim 14, wherein each said roof cap defines a fold line between its tailing and leading edges for bending the roof cap to a desired angle.

16. A shingle system as claimed in claim 15, wherein said fold line is defined by a peak formed on a weather exposed surface of each said roof cap.

17. A shingle system as claimed in claim 14, wherein said roof cap connector is defined by an overturned flange defined along said leading edge of said roof cap.

18. A fastening strip for shingles comprising:

an elongate top flange including a fastener portion for receiving fasteners;

a hook disposed along the length of said top flange for connecting said fastening strip to at least one upper shingle;

a lip disposed along the length of said top flange for aligning said fastening strip relative to a top edge of at least one lower shingle; and a gasket disposed continuously along the length of the top flange on a bottom surface of the fastener portion for providing a weather resistant seal between the fastening strip and said at least one lower shingle.

19. A fastening strip as claimed in claim 18, wherein a plurality of said hooks and said lips are disposed at spaced intervals along the length of said top flange.

20. A fastening strip as claimed in claim 18, further comprising a bottom flange connected to said top flange by a hinge to define a water resistant envelope for receiving a top edge of a shingle.

21. A shingled surface comprising:

a plurality of fastening strips arranged on a surface in parallel continuous rows, each said fastening strip having a top flange that includes a fastening portion;

a plurality of shingles, each said shingle having a top edge, a bottom edge and a connector, said shingles being arranged on said surface with said top edge of each shingle being covered by said top flange of one row of fastening strips, and each shingle being connected by said connector proximate to said bottom edge to another row of said fastening strips;

a plurality of fasteners extending through said fastening portion of said fastening strips to fasten at least said fastening strips to said surface; and a gasket located on a bottom surface of the fastening portion of each of said fastening strips, said gaskets defining a weather resistant seal between said fastening strips and said shingles proximate to said top edges.

22. A shingled surface as claimed in claim 21, wherein each said fastener extends through said fastening portion and at least one said shingle.

23. A shingled surface as claimed in claim 21, wherein each said fastening strip further comprises a bottom flange that extends beneath a bottom surface of said top flange, said bottom flange being connected to said top flange by a hinge.

24. A shingled surface as claimed in claim 21, wherein said shingles include side edge connecting means for connecting adjacent side edges of shingles together, and wherein said shingles are arranged on said surface with said adjacent side edges connected.

25. A shingled surface as claimed in claim 24, wherein said side edge connecting means comprises an overturned flange defined along one side edge of a shingle and an underturned flange defined along an opposing side edge of said shingle.

26. A shingled surface as claimed in claim 24, wherein said plurality of shingles comprises a plurality of first shingles and a plurality of second shingles, said side edge connecting means on each of said first shingles comprising overturned flanges on said opposing side edges, and said side edge connecting means on each of said second shingles comprising underturned flanges on said opposing side edges, wherein said first and second shingles are arranged alternately side by side on said surface.

27. A shingled surface as claimed in claim 26, wherein, for at least one of said first and second shingle configurations, the length of the top edge of the shingle differs from the length of the bottom edge of the shingle to define tapered side edges.

28. A shingled surface as claimed in claim 27, wherein each of said first and second shingle configurations define tapered side edges, the taper of the first shingle configuration being opposite to the taper of the second shingle configuration.

29. A shingled surface as claimed in claim 21, further comprising a plurality of roof caps, each said roof cap having a leading edge, a tailing edge, opposing side edges and a connector, said roof caps being arranged on a roof peak surface with at least some of said fastening strips being arranged in parallel rows extending transversely across said roof peak, and wherein said tailing edge of each said roof cap is covered by said top flange of one row of fastening strips, and said leading edge of each said roof cap is connected by said connector to another row of said fastening strips.

30. A shingled surface as claimed in claim 29, wherein each said roof cap defines a fold line between its tailing and leading edges for bending the roof cap to a desired angle.

31. A method of installing a plurality of shingles onto a surface, comprising the steps of:

(a) obtaining a plurality of fastening strips, each said fastening strip having a top flange that includes a fastener portion;

(b) obtaining a plurality of shingles, each said shingle having a top edge and a bottom edge, and each said shingle having a connector for connecting said shingle to said fastening strip proximate to said bottom edge;

(c) fastening at least one said fastening strip to said surface to define a lower fastening strip row;

(d) positioning at least one of said shingles on said surface with said connector connecting to said lower fastening strip row to define a shingle course;

(e) positioning at least one of said fastening strips on said surface with said top flange covering said top edge of said at least one shingle in said shingle course to define an upper fastening strip row;

(f) fastening said fastening strips in said upper fastening strip row to said surface with fasteners, said fasteners extending through both the fastening strip and said shingle into said surface, said upper fastening strip row now defining a new lower fastening strip row; and (g) repeating steps (d) through (f) until a desired amount of said surface is covered with said shingles.

32. A method as claimed in claim 31, wherein during step (d) said at least one shingle in said shingle course is slidably adjusted along said lower fastening strip row to a desired position.

33. A method as claimed in claim 31, further comprising a gasket located on a bottom surface of the fastening portion of said fastening strips, said gasket defining a weather resistant seal between said fastening strip and said shingles in said shingle course.

34. A method as claimed in claim 31, wherein said fastening strip further comprises a bottom flange that extends beneath a bottom surface of said top flange, said bottom flange being connected to said top flange by a hinge.

35. A method as claimed in claim 31, wherein said shingles include side edge connecting means for connecting adjacent side edges of shingles together, and wherein during said shingle positioning step said shingles are positioned on said surface with said adjacent side edges connected.

36. A method as claimed in claim 35, wherein said side edge connecting means comprises an overturned flange defined along one side edge of a shingle and an underturned flange defined along an opposing side edge of said shingle.

37. A method as claimed in claim 35, wherein said plurality of shingles comprises a plurality of first shingles and a plurality of second shingles, said side edge connecting means on each of said first shingles comprising overturned flanges on said opposing side edges, and said side edge connecting means on each of said second shingles comprising underturned flanges on said opposing side edges, wherein said first and second shingles are positioned alternately side by side on said surface.

38. A method as claimed in claim 37, wherein, for at least one of said first and second shingle configurations, the length of the top edge of the shingle differs from the length of the bottom edge of the shingle to define tapered side edges.

39. A method as claimed in claim 38, wherein each of said first and second shingle configurations define tapered side edges, the taper of the first shingle configuration being opposite to the taper of the second shingle configuration.

40. A method as claimed in claim 31, wherein each said fastening strip includes a lip, and wherein step (e) further comprises the step of utilizing said lip to align each said fastening strip relative to said top edge of said at least one shingle.

41. A method as claimed in claim 31, further comprising the step of obtaining a plurality of roof caps, each said roof cap having a leading edge, a tailing edge, opposing side edges and a connector, and further comprising the step of positioning said roof caps on a roof peak surface with at least some of said fastening strips being arranged in parallel rows extending transversely across said roof peak, and wherein said tailing edge of each said roof cap is covered by said top flange of one row of fastening strips, and said leading edge of each said roof cap is connected by said connector to another row of said fastening strips.

42. A method as claimed in claim 41, wherein each said roof cap defines a fold line between its tailing and leading edges for bending the roof cap to a desired angle.

* * * * *